US006609778B2

(12) United States Patent
Ingham et al.

(10) Patent No.: US 6,609,778 B2
(45) Date of Patent: Aug. 26, 2003

(54) DROPLET EJECTION APPARATUS

(75) Inventors: Ian Ingham, Cambridge (GB); Julian White, Cambridge (GB); Danny Palmer, Cambridge (GB); Robert A. Harvey, Cambridge (GB); Stephen Temple, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 38 days.

(21) Appl. No.: 09/844,737

(22) Filed: Apr. 27, 2001

(65) Prior Publication Data

US 2002/0021327 A1 Feb. 21, 2002

Related U.S. Application Data

(63) Continuation of application No. PCT/GB99/03590, filed on Nov. 1, 1999.

(30) Foreign Application Priority Data

Oct. 31, 1998 (GB) ..... 9823833

(51) Int. Cl.[7] ..... B41J 2/015
(52) U.S. Cl. ..... 347/20
(58) Field of Search ..... 347/44, 20, 63, 347/47

(56) References Cited

U.S. PATENT DOCUMENTS 6,079,810 A * 6/2000 Davis ..... 347/20

FOREIGN PATENT DOCUMENTS

| | | |
|---|---|---|
| EP | 0 528 440 A1 | 2/1993 |
| EP | 0 630 753 A2 | 12/1994 |
| JP | 5155017 A | 6/1993 |

OTHER PUBLICATIONS

International Search Report for PCT/GB99/03590 dated Mar. 3, 2000.
International Preliminary Examination Report for PCT/GB99/03590 dated Jul. 19, 2000.

* cited by examiner

*Primary Examiner*—John Barlow
*Assistant Examiner*—Michael S Brooke
(74) *Attorney, Agent, or Firm*—Marshall, Gerstein & Borun

(57) ABSTRACT

A method for prevention of nozzle plate peel for inkjet printheads. The nozzle plate is bonded to the nozzle, with a layer of adhesive, and to a support, with a thicker layer of adhesive. This extra support prevents the peeling of the nozzle plate under the forces generated by, for example, a wiper blade passing over it. Spacers between the nozzle plate and support ensure the correct uniformity and constant thickness of the adhesive layer.

11 Claims, 5 Drawing Sheets

DROPLET EJECTION APPARATUS

This is a continuation of International Application No. PCT/GB99/03590 filed Nov. 1, 1999, the entire disclosure of which is incorporated herein by reference.

The present invention relates to droplet ejection apparatus, in particular an inkjet printhead, comprising at least one chamber formed in a body and communicating with droplet liquid supply means and with a respective nozzle formed in a separate nozzle plate, the apparatus further comprising means for effecting ejection of droplets from the nozzle.

As is well known, inkjet printhead operation can be disrupted when the printhead nozzles become blocked with dry ink residue, paper dust and the like. It is well known to keep nozzles clear by wiping the nozzle plate and/or, covering the nozzles ("capping") and washing the nozzle plate with an appropriate liquid ("flushing") or forcing ink through the nozzles ("purging") either by applying a vacuum to the nozzle plate or by applying pressure to the ink supply. The ink emitted during the purging process is typically collected in a cap that seals with the outlet surface of the nozzle plate. The cap may also be placed on the nozzle plate when the printhead is dormant, thereby to reduce the rate at which ink in the nozzles dries out.

The nozzles are typically formed in the nozzle plate by laser ablation, for example by the method described in WO 93/15911 (belonging to the applicant and incorporated herein by reference) and to this end the nozzle plate is generally manufactured from a separate, thin (typically 50 $\mu$m) sheet of ablatable material, typically polyimide, polycarbonate, polyester or polyetheretherketone, although, acrylics or non-vitreous inorganic material might also be used.

The nozzle plate is of necessity sealed to the body at the end of the channels, generally by means of adhesive. In addition, the nozzle plate may be extended some way above, below and to either side of the body and the ends of the channels so as to provide a surface of area sufficient to ensure effective sealing of the cap.

It has been found that an extended nozzle plate made of the thin material discussed above requires support at its periphery. It has further been found that the demands placed on the adhesive bond attaching the nozzle plate to such a support differ from those placed on the adhesive bond attaching the nozzle plate to the body in which the ink chambers are formed. In the latter case, the adhesive layer is made as thin as possible consistent with an effective body/nozzle plate seal between adjacent ink chambers, thereby minimising the amount of adhesive that might otherwise flow into and (at least partially) block up the ink chambers. However it has been found that such a thin layer is not sufficiently robust to withstand the forces generated elsewhere on the nozzle plate and particularly at its periphery during the aforementioned capping, wiping and other processes. Of these forces, the peel force generated, for example, by a wiper blade passing over the edge of the nozzle plate, has been found to be the most significant.

It is an object of the present invention to provide a printhead better adapted to the demands of manufacture and operation.

Accordingly, the present invention consists in one aspect in droplet ejection apparatus, comprising a body having at least one droplet liquid chamber; a separate nozzle plate providing a respective nozzle for each droplet chamber, the nozzle plate being bonded to the body by means of a first adhesive layer having a first average thickness; and a nozzle plate support bonded to the nozzle plate by means of a second adhesive layer having a second average thickness greater than said first average thickness.

Preferably, the first and second adhesive layers lie substantially in the same plane.

Suitably, the nozzle plate has an outlet surface containing the outlet of each nozzle and an inlet surface containing the inlet of each nozzle, the body and the nozzle plate support being bonded to the inlet surface of the nozzle plate.

The present invention consists in another aspect in a method of manufacturing droplet ejection apparatus which comprises a body having at least one droplet liquid chamber and a termination plane to which the or each chamber opens; a separate nozzle plate bonded to the termination plane of the body and providing a respective nozzle for each droplet, and a nozzle plate support bonded to the nozzle plate, the method comprising the steps of applying an adhesive layer to the nozzle plate; applying an adhesive layer to the nozzle plate support; aligning the adhesive layer on the nozzle support with the termination plane of the body and contacting the adhesive layer on the nozzle plate with the body and with the adhesive layer on the nozzle support, thereby to produce an adhesive bond layer between the nozzle plate and the nozzle plate support which is thicker than the adhesive bond layer between the nozzle plate and the body.

The use of nozzle plate/support means and nozzle plate/printhead body adhesive layers of differing thickness allows printhead integrity to be maintained during operation without compromising manufacturing quality.

Advantageous embodiments of the invention are set out in the description and dependent claims.

The invention will now be described by way of example by reference to the following diagrams, of which:

Figure 1:
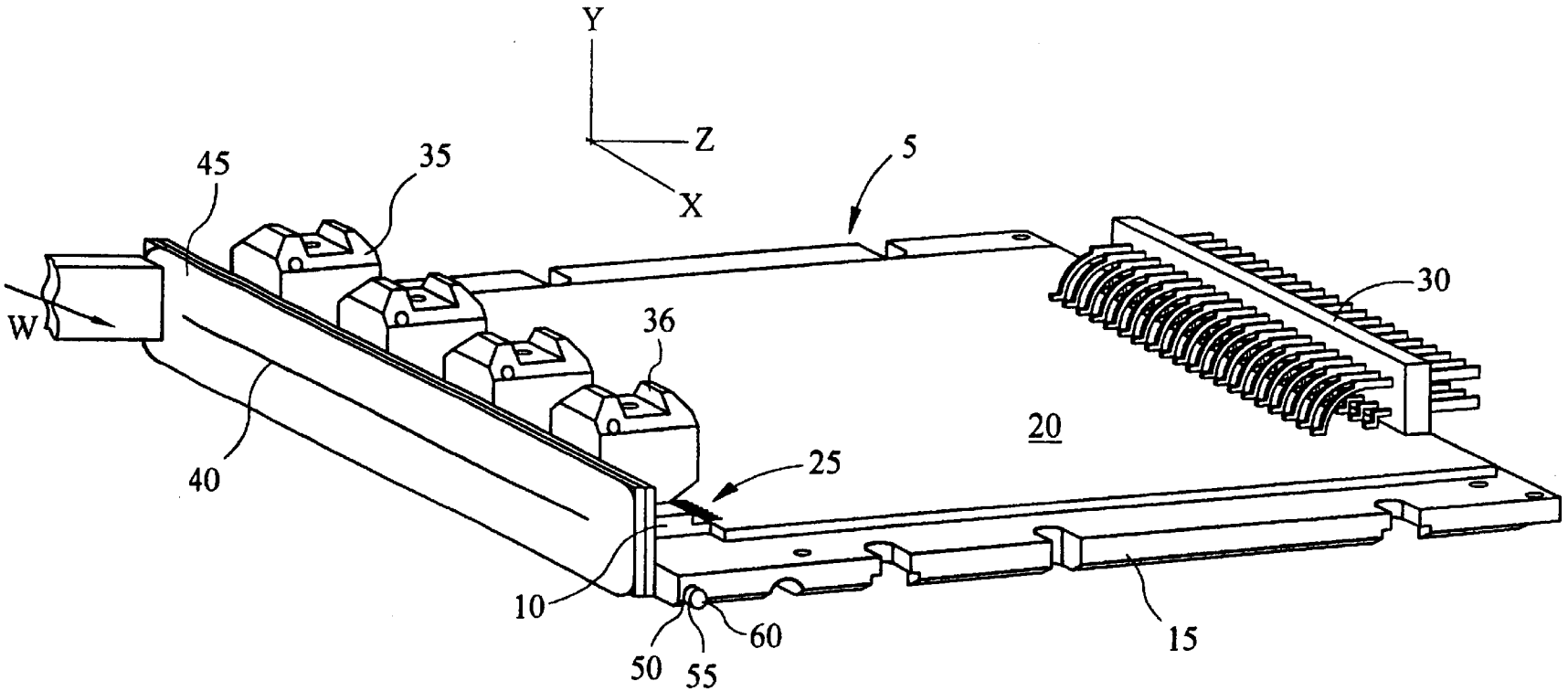
FIG. 1 is a perspective view of a printhead manufactured according to the present invention.

FIG. 1 depicts an inkjet printhead 5 manufactured according to the present invention and comprising an ink ejection unit or units 10 mounted at one end of a base member 15. Base member 15 may be made of a thermally conductive material such as aluminium so as to carry away heat generated both in the ink ejection units and in printhead driving circuitry mounted on circuit board 20. Driving signals are conveyed from one end of the circuit board to the ink ejection units, for example by wire bonds 25, whilst print data and power arrive at the other end of the circuit board via connector 30.

As shown, four manifolds 35 supply ink of four different colours (generally cyan, magenta, yellow and black) to four neighbouring ink ejection units, although these manifolds could equally well supply the same colour ink to all ink ejection units or be replaced by a single ink manifold. As explained hereafter, registration between the channels of the different ink ejection units is achieved e.g. by forming all four units in a single base member. Manifolds 35 are clamped in sealing contact with the ink ejection units 10 by means of a bar (not shown) that sits in recesses 36 and which in turn is secured—e.g. by means of bolts—to chassis 15.

These features are known in the art, e.g. from WO97/04963 belonging to the applicant and incorporated herein by reference, and consequently do not require discussion in any further detail. Ink ejection takes place from a line of nozzles 40 formed in a nozzle plate 45, with each nozzle communicating with a respective ink-ejecting chamber of the ink ejecting unit 10.

Figure 2:
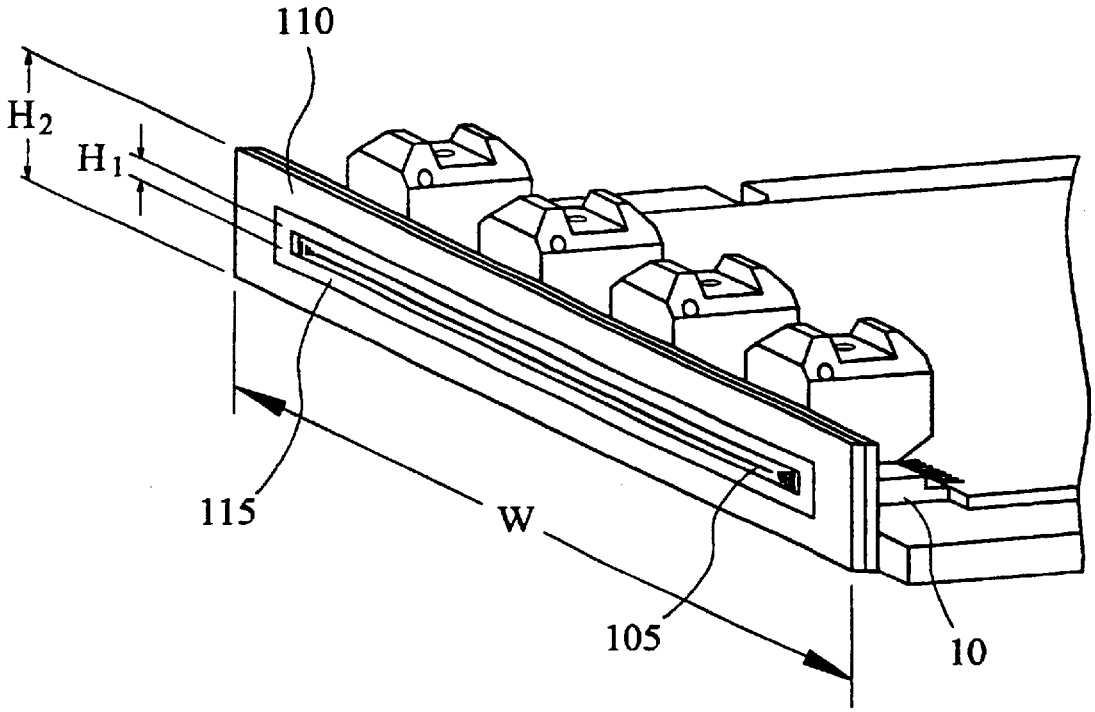
FIG. 2 is an enlarged view of the front end of the printhead of FIG. 1 with the nozzle plate removed.
Figure 3:
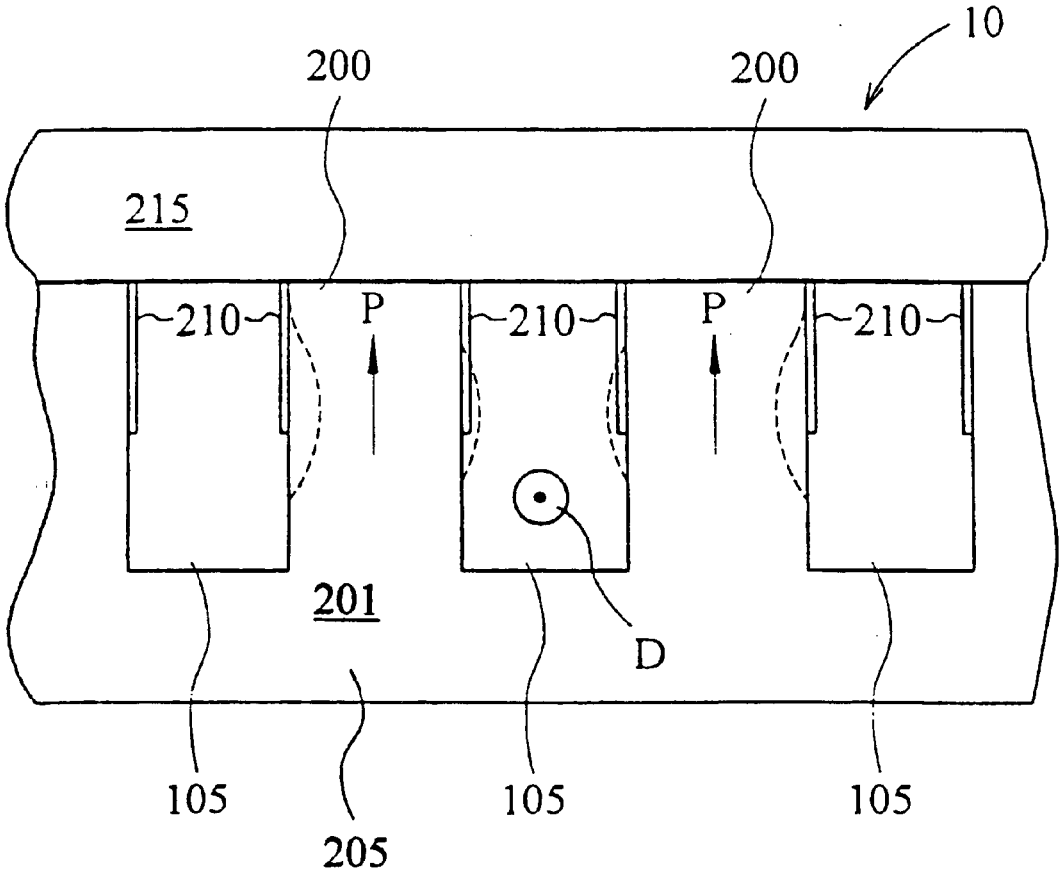
FIG. 3 is a cross-sectional view through channels of the ink ejecting units of FIG. 1.

Although the present invention is not limited to any particular kind of droplet ejecting apparatus, the arrangement described by way of example above and shown in FIG. 2 with the nozzle plate removed incorporates an ink ejecting unit that utilizes shear mode wall actuators. FIG. 3 shows sectional detail of an ink ejecting unit 10 having a line of ink-ejecting chambers 105. These are of the kind disclosed in the aforementioned WO97/04963 or in EP-A-0 364 136 (also belonging to the applicant and incorporated herein by reference) and comprise ink-ejecting channels 105 having a longitudinal axis D and defined by actuator side walls 200 of poled piezoelectric material such as lead zirconium titanate (PZT). By means of electrodes 210 arranged in or on the walls, an electric field is applied to the piezoelectric material and normal to the direction P of polarisation thereof so as to cause the walls to deflect by shear mode into the ink channel (as indicated by broken lines in FIG. 6) thereby to eject a droplet from a respective nozzle. For ease of manufacture, the entire ink ejecting unit comprising channel walls 200, base 205 and cover 215 may be made of piezoelectric material (the material of the cover need not be poled). Furthermore, several channel groups for ejecting several different colours of ink may be formed in a single base 205—registration between channels of different channel groups is thereby guaranteed.

The nozzle plate is arranged at one end of the channels 105 (in the plane of the paper in FIG. 3) and is in sealing contact with a common channel termination plane 201 lying perpendicular to the channel axes and formed by the ends of the channel walls 200, base 205 and cover 210.

Figure 4:
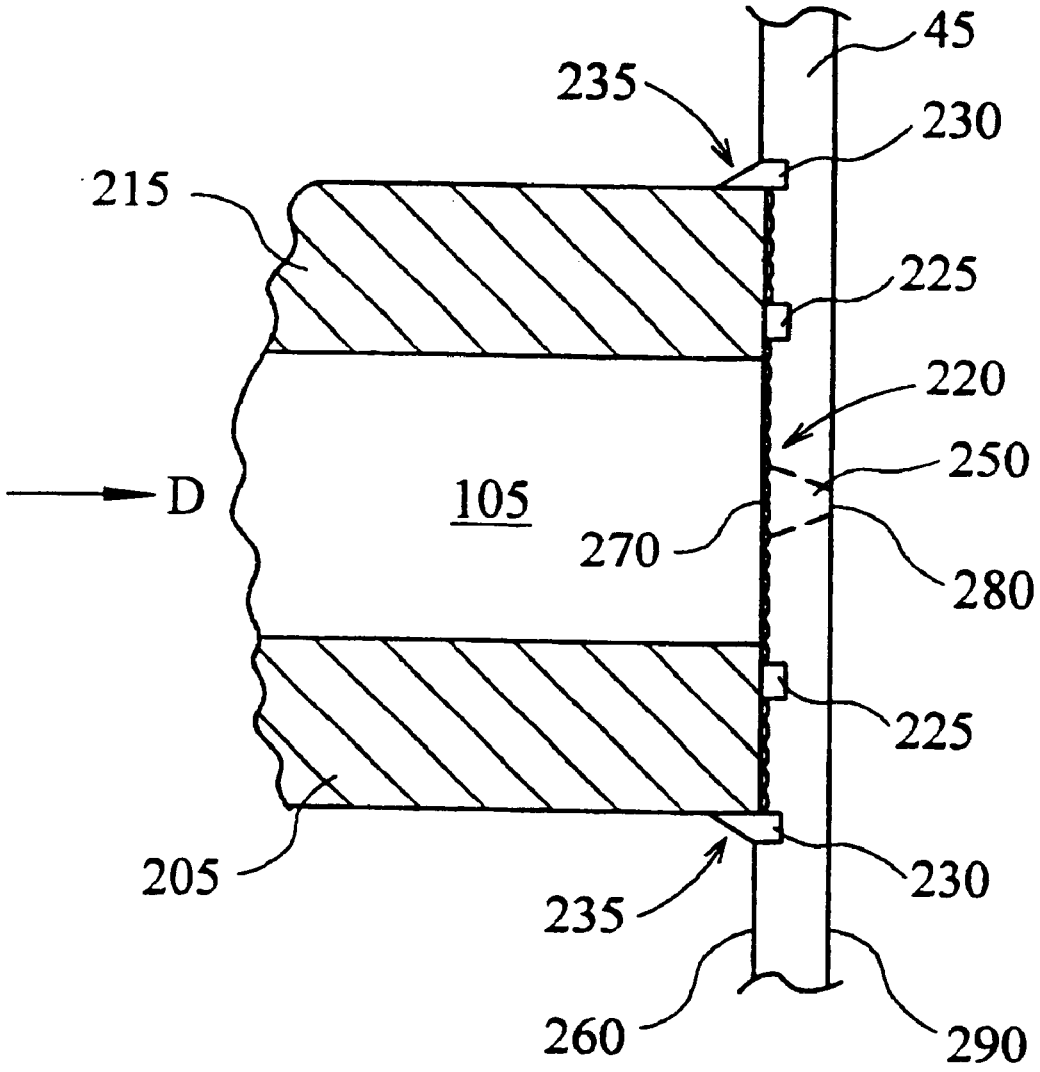
FIG. 4 is a detailed sectional view of the front end of the ink ejecting units of FIG. 1 taken parallel to the ink channel axis D.

FIG. 4 shows an example of a nozzle plate/printhead body adhesive bond 220 prior to nozzle formation, the axis of the ink channel 105 being indicated by arrow D. The rear surface 260 of the nozzle plate is scalloped as described in WO95/11131 (belonging to the present applicant and incorporated herein by reference) and has grooves 225 formed above and below the channels to accommodate excess glue, thereby to ensure a substantially constant adhesive layer thickness. Further grooves 230 may also be formed at the junction of the nozzle plate with the top and bottom surfaces of cover 215 and base 205 respectively. Excess adhesive collecting in these channels forms fillets 235 which further strengthen the nozzle plate/ink ejecting unit bond.

Shown by dashed lines at 250 is the position of the nozzle that is formed as described hereinafter. Nozzle inlet 270 is formed in the rear surface 260 and communicates with channel 105 whilst nozzle outlet 280 is formed in the front surface 290 of the nozzle plate.

As mentioned above and illustrated in FIG. 1, the termination plane 201 of the channels 105 of ink ejecting unit 10 is bonded to a central region of the nozzle plate 45 which itself extends some way above, below and to either side of the central region so as to provide an outlet surface 290 of area sufficient to ensure effective sealing of a cap. This is shown in more detail in FIG. 5 (a sectional view of the front end of the printhead of FIG. 1 taken parallel to the ink channel axis D) which also shows in more detail support 110 for the periphery of the nozzle plate.

In the example shown, support 110 is a two-part construction comprising an aluminium member 300 which is attached to base member 15 by a bond 310 and which reinforces alumina member 305. Alumina member 305 provides a smooth surface to which the nozzle plate can be attached. Such a construction is disclosed in co-pending PCT application no. GB98/02519, incorporated herein by reference.

Figure 5:
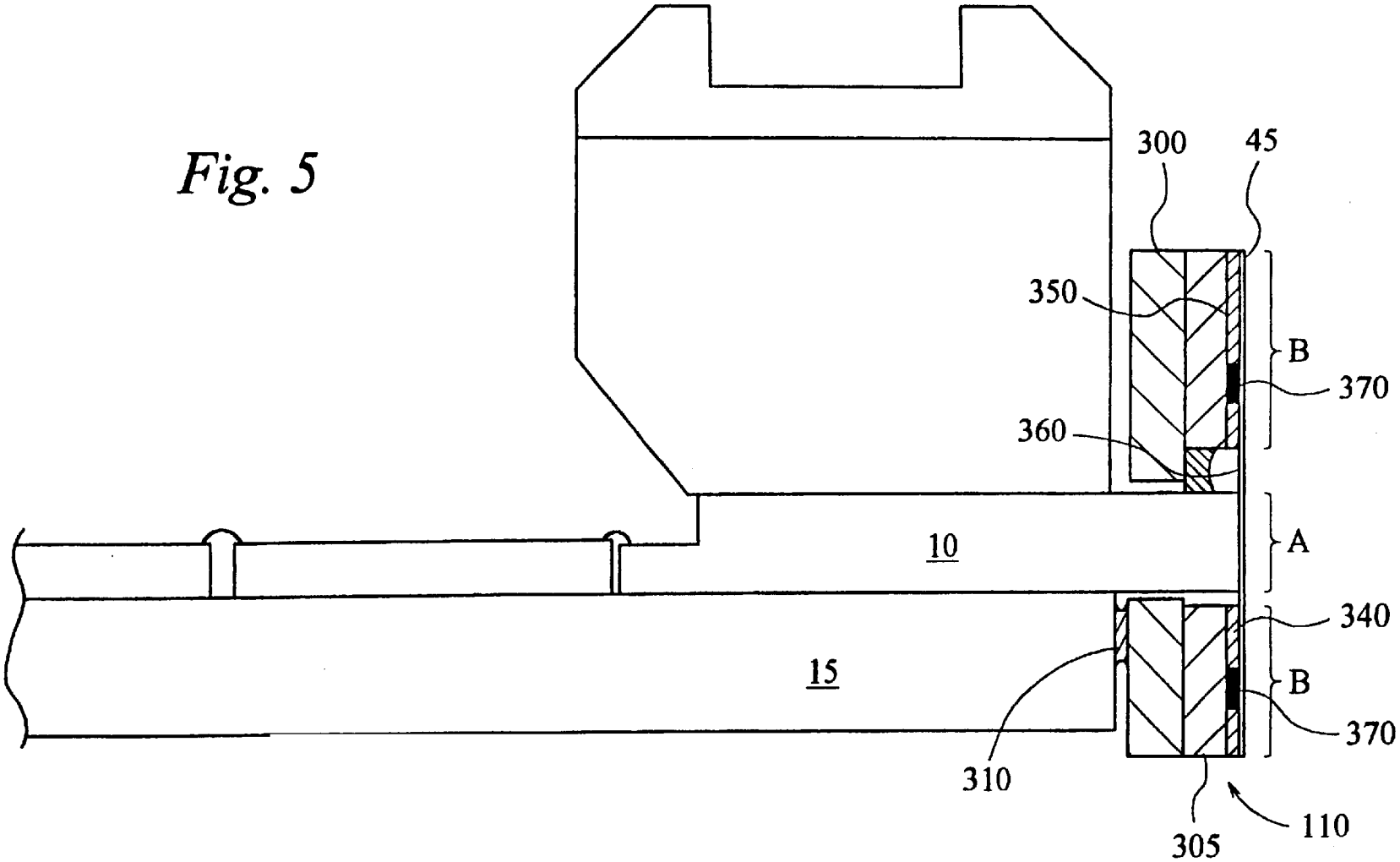
FIG. 5 illustrates the present invention by way of a sectional view of the front end of the printhead of FIG. 1 taken parallel to the ink channel axis D.

In the region of the ink ejection unit 10, indicated by "A" in FIG. 5, the rear surface of nozzle plate 45 is attached to unit 10 by an adhesive layer of the kind illustrated in FIG. 4 and typically of 3 to 5 $\mu$m average thickness in the case of epoxy glues such as Epotek (Trade Mark). As mentioned above, such an adhesive layer has been found to give adequate strength and sealing between channels whilst minimising the risk of blocking the printhead channels.

One useful technique for applying this adhesive layer is roll adhesive onto the rear surface of the nozzle plate using a bar coder to give a 6 to 7 $\mu$m coating. A compliant pad is then applied to the adhesive and peeled off taking with it between 30 to 50% of the adhesive.

In contrast, in the region of the nozzle plate support (indicated at "B" in FIG. 5), the rear surface 260 of nozzle plate 45 is attached by means of an adhesive layer 340 of substantially greater thickness which provides increased strength, in particular peel strength. It will be appreciated that potentially high peel forces are generated at the periphery of the nozzle plate whenever a wiper is drawn across the nozzle plate for cleaning purposes, typically along the row of nozzles as indicated diagrammatically at "W" in FIG. 1. The present inventors have established that acceptable peel strength is obtained with a layer having an thickness at least twice and preferably three or four times greater than that of the adhesive layer between the nozzle plate and the ejection unit. In the embodiment shown, a thickness of 15 to 20 $\mu$m of Epotek (Trade Mark) adhesive was used.

Resistance to peel forces acting along the row of nozzles has also been found to be affected by the extent of the nozzle plate/support adhesive layer in a direction perpendicular to the row of nozzles. At least half, and preferably at least two-thirds of the nozzle plate is supported in a direction perpendicular to the row of nozzles, as illustrated in FIG. 5.

The arrangement of FIG. 5 is advantageously manufactured by first attaching support 110 to the base 15 and ink ejecting unit 10, the front surface of unit 10 standing proud of the front surface 350 of the support by an amount corresponding to the desired thickness of glue layer 340. Thereafter, a thick layer of adhesive is applied to the front surface 350 of alumina member 305 (e.g. from a nozzle), a thin layer of adhesive is applied to the rear surface 360 of nozzle plate (e.g. by means of a roller) and nozzle plate is brought into contact with the front surfaces of support and ink ejecting unit. It will be appreciated that the thick and thin adhesive layers to a certain degree merge with one another at this point to form a continuous adhesive layer. Pressure and heat are then applied in the conventional manner to cure the adhesive.

An adequate and constant thickness of bond 340 may ensured by appropriate jigging. An alternative is the use of appropriately dimensioned spacers 370 between the support 110 and nozzle plate rear surface 360. In FIG. 5, these spacers take the form of strips—conveniently of nozzle plate material—which are attached to the front surface 350 of support 110 prior to application of adhesive. However, spacers—of which there may be a plurality—may equally well be integrated into the nozzle plate and/or into support 110, where they may be defined between grooves or trenches formed in the front surface 350 of the support and of a depth corresponding to the glue layer thickness desired. Spacers may furthermore run parallel to the row of nozzles, as shown in FIG. 5, or perpendicular thereto. The latter arrangement may increase the coverage of the glue layer when seen in cross-section taken perpendicular to the direction of the row of nozzles, thereby increasing resistance to peel forces generated during wiping.

The formation of nozzles may be deferred until after the nozzle plate has been attached to the ink ejection unit 10 so as to minimise problems with nozzle/channel registration, as is known in the art.

Whilst the present invention has been described with reference to piezoelectric inkjet printheads, it should be understood that this is by way of example only and that the invention is equally applicable to other kinds of droplet ejecting apparatus.

What is claimed is:

1. Droplet ejection apparatus, comprising a body having at least one droplet liquid chamber; a separate nozzle plate providing a respective nozzle for each droplet chamber, each nozzle having a respective inlet and outlet, the nozzle plate being bonded to the body by means of a first adhesive layer having a first average thickness; and a nozzle plate support bonded to the nozzle plate by means of a second adhesive layer having a second average thickness greater than said first average thickness.

2. Apparatus according to claim 1, wherein the first and second adhesive layers lie substantially in the same plane.

3. Apparatus according to claim 1, wherein the nozzle plate has an outlet surface containing the outlet of each nozzle and an inlet surface containing the inlet of each nozzle, the body and the nozzle plate support being bonded to the inlet surface of the nozzle plate.

4. Apparatus according to claim 1, wherein the nozzle plate has a periphery and the nozzle plate support is positioned to support substantially the entire periphery of the nozzle plate.

5. Apparatus according to claim 1, wherein the area of the second adhesive layer is larger than the area of the first adhesive layer.

6. Droplet ejection apparatus comprising; at least one chamber formed in a body and communicating with droplet liquid supply means and with a respective nozzle having an outlet and formed in a separate nozzle plate; and means for effecting ejection of droplets from the nozzle; wherein the outlet of each respective nozzle is formed in a first surface of the nozzle plate having a first area, the nozzle plate and body being bonded to one another over a second area smaller than the first area by means of a first adhesive layer having a first average thickness; and wherein the apparatus further comprises support means for supporting the periphery of the nozzle plate, said support means being bonded to the periphery of the nozzle plate by means of a second adhesive layer having a second average thickness greater than said first average thickness.

7. Apparatus according to claim 6, wherein each adhesive layer has a substantially uniform thickness.

8. Apparatus according to claim 6, wherein the nozzle plate is located centrally relative to the body.

9. Apparatus according to claim 6, wherein said at least one chamber has a longitudinal axis and terminates in a termination plane oriented perpendicular to said axis, the first surface of the nozzle plate lying substantially parallel to said termination plane.

10. Apparatus according to claim 6, wherein spacers are interposed between the nozzle plate and the support means.

11. Aparatus according to claim 6, wherein said second adhesive layer is thicker than said first adhesive layer by a factor of three or more.

* * * * *